US009869001B2

(12) United States Patent
Noguchi

(10) Patent No.: US 9,869,001 B2
(45) Date of Patent: Jan. 16, 2018

(54) HEAT TREATMENT OIL COMPOSITION

(71) Applicant: IDEMITSU KOSAN CO., LTD., Chiyoda-ku (JP)

(72) Inventor: Kenro Noguchi, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 163 days.

(21) Appl. No.: 14/762,695

(22) PCT Filed: Jan. 29, 2014

(86) PCT No.: PCT/JP2014/051961
§ 371 (c)(1),
(2) Date: Jul. 22, 2015

(87) PCT Pub. No.: WO2014/123048
PCT Pub. Date: Aug. 14, 2014

(65) Prior Publication Data

US 2015/0361517 A1 Dec. 17, 2015

(30) Foreign Application Priority Data

Feb. 6, 2013 (JP) ..... 2013-021329

(51) Int. Cl.
*C21D 1/58* (2006.01)
*C10M 145/22* (2006.01)

(52) U.S. Cl.
CPC ..... *C21D 1/58* (2013.01); *C10M 145/22* (2013.01); *C10M 2203/104* (2013.01); *C10M 2203/1006* (2013.01); *C10M 2205/026* (2013.01); *C10M 2209/102* (2013.01); *C10M 2215/08* (2013.01); *C10N 2220/022* (2013.01); *C10N 2230/02* (2013.01); *C10N 2240/40* (2013.01)

(58) Field of Classification Search
CPC ..... C10M 145/22; C10M 2203/1006; C10M 2203/104; C10M 2209/102; C10M 2215/08; C10M 2205/026; C21D 1/58; C10N 2240/40; C10N 2220/022; C10N 2230/02
See application file for complete search history.

(56) References Cited

U.S. PATENT DOCUMENTS

| | | | | |
|---|---|---|---|---|
| 2,850,454 | A * | 9/1958 | Morway | C10M 5/00 508/415 |
| 3,682,694 | A * | 8/1972 | Kato et al. | D06M 7/00 252/8.84 |
| 2009/0056834 | A1* | 3/2009 | Kobessho | C10M 171/00 148/29 |
| 2010/0186853 | A1* | 7/2010 | Ichitani | C10M 129/28 148/29 |
| 2012/0184475 | A1 | 7/2012 | Takagi et al. | |
| 2012/0309656 | A1* | 12/2012 | Umehara | C10M 137/04 508/423 |
| 2014/0261926 | A1* | 9/2014 | Parodi | C21D 1/56 148/713 |
| 2014/0373584 | A1* | 12/2014 | Takagi | C10M 169/04 72/42 |

FOREIGN PATENT DOCUMENTS

| | | |
|---|---|---|
| CN | 1923989 A | 3/2007 |
| CN | 102725387 A | 10/2012 |
| JP | 5 239481 | 9/1993 |
| JP | 10 8077 | 1/1998 |
| JP | 2010 229479 | 10/2010 |
| JP | 2011 111593 | 6/2011 |
| TW | 200923015 A | 6/2009 |

OTHER PUBLICATIONS

Combined Chinese Office Action and Search Report dated Aug. 4, 2016 in Patent Application No. 201480006512.7 (with English language translation).
International Search Report dated Mar. 18, 2014 in PCT/JP2014/051961 Filed Jan. 29, 2014.
Taiwanese Notice of Allowance and Search Report dated Jan. 11, 2017 in patent application No. 103103774 with English translation of Notice of Allowance and English translation of Categories of Cited Documents.
Combined Office Action and Search Report dated Mar. 1, 2017 in Chinese Patent Application No. 201480006512.7 (with partial English translation and English translation of categories of cited documents).
Oh fu, "Petroleum Product Application Technology Handbook" China Petrochemical Press Co., Ltd., 1st edition, Jun. 1998, pp. 857-860.

* cited by examiner

*Primary Examiner* — Veronica F Faison
(74) *Attorney, Agent, or Firm* — Oblon, McClelland, Maier & Neustadt, L.L.P.

(57) ABSTRACT

A heat-treatment oil composition contains (A) at least one of a hydroxy fused fatty acid having a polymerization degree of 2 or more and a derivative of the hydroxy fused fatty acid. The heat-treatment composition may also contain (B) at least one of a mineral oil and a synthetic oil.

8 Claims, No Drawings

HEAT TREATMENT OIL COMPOSITION

CROSS-REFERENCE TO RELATED APPLICATIONS

This application is a National Stage of PCT/JP2014/051961, which was filed on Jan. 29, 2014. This application is based upon and claims the benefit of priority to Japanese Application No. 2013-021329, which was filed on Feb. 6, 2013.

TECHNICAL FIELD

The present invention relates to a heat-treatment oil composition used for, for instance, quenching a metal material.

BACKGROUND ART

A heat treatment such as quenching is usually performed using a heat-treatment oil to provide a metal material with a desired hardness. The heat-treatment oil thus needs to exhibit an excellent cooling performance to enhance the hardness of the metal material. The heat-treatment oil is categorized into a cold oil designed to be used at a low oil temperature and a hot oil usable at a high oil temperature.

The cold oil usually contains a low-viscosity base oil and thus exhibits a high cooling performance with a high cooling speed. The cold oil, however, experiences a long-term vapor film stage, so that the usage of the cold oil may result in uneven quenching and, consequently, quenching distortion. Accordingly, the cold oil is frequently blended with a vapor-film rupturing agent to shorten the vapor film stage. Asphalt or polymer compound is generally usable as the vapor-film rupturing agent (see Patent Literature 1).

CITATION LIST

Patent Literature(s)

Patent Literature 1: JP-A-2010-229479

SUMMARY OF THE INVENTION

Problems to be Solved by the Invention

A heat-treatment oil containing asphalt as a vapor-film rupturing agent exhibits a stable vapor-film rupturing effect, but causes problems such as lowering the luster of a workpiece and deteriorating a work environment (e.g., stain on and around an oil bath).

A heat-treatment oil containing a polymer compound as a vapor-film rupturing agent does not cause the problems such as lowering the luster and deteriorating a work environment, but the vapor-film rupturing effect of the heat-treatment oil is poor in persistency.

In view of the above, an object of the invention is to provide a heat-treatment oil composition capable of: exhibiting a long-lasting excellent vapor-film rupturing effect when used in a heat treatment such as quenching of a metal material; and providing a workpiece with an excellent luster.

Means for Solving the Problems

In order to solve the above problems, according to an aspect of the invention, the following heat-treatment oil compositions are provided.

(1) A heat-treatment oil composition contains a component (A) that is at least one of a hydroxy fused fatty acid having a polymerization degree of 2 or more and a derivative of the hydroxy fused fatty acid.

(2) The heat-treatment oil further contains a component (B) that is at least one of a mineral oil and a synthetic oil.

(3) In the heat-treatment oil composition, a blend ratio of the component (A) is in a range from 1 mass % to 10 mass % of a total amount of the heat-treatment oil composition, and a blend ratio of the component (B) is in a range from 90 mass % to 99 mass % of the total amount of the heat-treatment oil composition.

(4) In the heat-treatment oil composition, the derivative of the hydroxy fused fatty acid contains at least one of an esterified product of the hydroxy fused fatty acid, an amidated product of the hydroxy fused fatty acid and a hydrogenated product of the hydroxy fused fatty acid.

(5) In the heat-treatment oil composition, a polymerization degree of the hydroxy fused fatty acid in the component (A) is in a range from 2 to 10.

(6) In the heat-treatment oil composition, the hydroxy fused fatty acid in the component (A) is prepared by fusing a hydroxy fatty acid consisting mainly of a ricinoleic acid.

(7) In the heat-treatment oil composition, characteristic seconds of the heat-treatment oil composition according to a cooling performance test (JIS K 2242) are three seconds or less.

The heat-treatment oil composition of any one of the above aspects is capable of: exhibiting a long-lasting excellent vapor-film rupturing effect during a heat treatment such as quenching of a metal material; and providing a workpiece with an excellent luster.

DESCRIPTION OF EMBODIMENT(S)

A heat-treatment oil composition according to an exemplary embodiment of the invention contains a component (A): at least one of a hydroxy fused fatty acid having a polymerization degree of 2 or more and a derivative of the hydroxy fused fatty acid. The exemplary embodiment of the invention will be described below in detail.

When contained in the heat-treatment oil composition, the component (A) contributes to significantly improving a cooling performance of the composition on a metal material (a workpiece) and prolonging a cooling effect of the composition. Further, the component (A) provides the workpiece with an excellent luster.

The hydroxy fused fatty acid is prepared by fusing a hydroxy fatty acid. The derivative of the hydroxy fused fatty acid may be at least one of an esterified hydroxy fused fatty acid (sometimes referred to as an "esterified product" hereinafter), an amidated hydroxy fused fatty acid (sometimes referred to as an "amidated product" hereinafter), and a hydrogenated hydroxy fused fatty acid (sometimes referred to as a "hydrogenated product" hereinafter). The hydroxy fused fatty acid may be esterified, amidated or hydrogenated as needed to improve a compatibility of the component (A) with a base oil and chemical stability and/or antifoaming property of the component (A) or to adjust the cooling performance.

Examples of the esterified product of the hydroxy fused fatty acid include: a product prepared by esterifying a hydroxyl group in the hydroxy fused fatty acid with a fatty acid; a product prepared by esterifying a carboxyl group in the hydroxy fused fatty acid with an alcohol; and a product prepared by esterifying a hydroxyl group and a carboxyl group in the hydroxy fused fatty acid with a fatty acid and an alcohol, respectively. Examples of the amidated product of the hydroxy fused fatty acid include a product prepared by amidating a carboxyl group in the hydroxy fused fatty acid with an amine. Examples of the hydrogenated product of the hydroxy fused fatty acid include a product prepared by hydrogenating a part or all of the unsaturated bonds in the hydroxy fused fatty acid or the esterified product of the hydroxy fused fatty acid.

In the component (A), the fatty acid used to prepare the esterified product of the hydroxy fused fatty acid may be a monocarboxylic acid or a polycarboxylic acid. The above carboxylic acids are not particularly limited in type. However, the carboxylic acids preferably have 1 to 20 carbon atoms, and the monocarboxylic acid is particularly preferably an oleic acid, a sebacic acid or the like. The alcohol used to prepare the esterified product of the hydroxy fused fatty acid is preferably a monoalcohol or a polyalcohol. Examples of the monoalcohol or the polyalcohol include ethylene glycol, propylene glycol, diethylene glycol, neopentyl glycol, glycerin, erythritol, pentaerythritol, sorbitol (sorbitan), xylitol and trimethylolpropane. Examples of the esterified product of the polyalcohol or the polycarboxylic acid include a partial esterified product and a complete esterified product.

The amidated product of the hydroxy fused fatty acid may be in the form of a primary amide, a secondary amide, a tertiary amide or an imide. An amine used to prepare the above amides is preferably any one of various monoamines and polyamines.

The polymerization degree of the hydroxy fused fatty acid in the component (A) is 2 or more and preferably in a range from 2 to 10. The hydroxy fused fatty acid is preferably prepared by fusing a hydroxy fatty acid consisting mainly of a ricinoleic acid. The blend ratio of each of the hydroxy fused fatty acid and the derivative of the hydroxy fused fatty acid in the component (A) and the blend ratio of each of the esterified product, the amidated product, the hydrogenated product and the like in the derivative of the hydroxy fused fatty acid may be appropriately determined in accordance with properties required of the heat-treatment oil composition.

The present heat-treatment oil composition is preferably provided by further blending a component (B): at least one of a mineral oil and a synthetic oil.

Examples of the mineral oil in the component (B) include a paraffinic mineral oil, an intermediate mineral oil and a naphthenic mineral oil. Examples of the synthetic oil include: alpha-olefin oligomer (including an oligomerized alpha-olefin having 6 to 16 carbon atoms and a hydride of the oligomerized alpha-olefin); an olefin (co)polymer having 2 to 16 carbon atoms; alkylbenzene; alkylnaphthalene; polyphenyl hydrocarbon; esters; fatty acid esters of polyalcohols such as neopentyl glycol, trimethylol propane and pentaerythritol; and derivatives of polyoxyalkylene glycol.

In the present heat-treatment oil composition, the component (A) and the component (B) are preferably blended in the following ratios of the total amount of the heat-treatment oil composition.

Component (A): 1 mass % to 10 mass %

Component (B): 90 mass % to 99 mass %

The blend ratio of the component (A) is preferably in a range from 1 mass % to 10 mass % of the total amount of the composition, more preferably from 1 mass % to 5 mass %, and further preferably from 1 mass % to 3 mass %. The blend ratio of the component (B) is preferably in a range from 90 mass % to 99 mass % of the total amount of the composition, more preferably from 95 mass % to 99 mass %, and further preferably from 97 mass % to 99 mass %.

When the blend ratio of the component (A) is less than 1 mass %, the composition may fail to exhibit a sufficient cooling performance. Further, the composition may fail to provide an excellent luster. However, even when the blend ratio of the component (A) exceeds 10 mass %, the component (A) does not significantly contribute to improvement of the cooing performance, but may increase the viscosity of the composition and, consequently, lower the cooling performance.

The present heat-treatment oil composition is basically prepared by blending the component (B) (a base oil) with the component (A). In this case, the component (A) functions as a vapor-film rupturing agent. With the component (A) blended as a vapor-film rupturing agent, a vapor film stage can be shortened and the cooling performance can be restrained from strengthening in a boiling stage, thereby reducing quenching distortion resulting from uneven cooling. Further, a temperature variation during the boiling stage can be increased to ensure the hardness of the workpiece.

In the present heat-treatment oil composition, the component (A) may be used as the base oil. In this case, the component (A) functions not only as the base oil but also as the vapor-film rupturing agent.

The characteristic seconds of the present heat-treatment oil composition measured by a cooling performance test (JIS K 2242) are preferably three seconds or less. A vapor film with a shortened length can be ruptured with reduced unevenness, so that distortion unevenness and hardness unevenness can be reduced irrespective of the shape of a material or a component to be quenched.

The present heat-treatment oil composition may be added with additives including an antioxidant and a detergent dispersant that can typically be added in a heat-treatment oil, as needed.

As the antioxidant, known phenolic antioxidant and amine antioxidant are usable.

Examples of the phenolic antioxidant include: monocyclic phenols such as 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl)phenol, 2,6-di-tert-amyl-4-methylphenol, and n-octadecyl-3-(4-hydroxy-3,5-di-tert-butylphenyl)propionate; and polycyclic phenols such as 4,4'-methylenebis(2,6-di-tert-butylphenol), 4,4'-isopropylidenebis(2,6-di-tert-butylphenol), 2,2'-methylenebis(4-methyl-6-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 4,4'-butylidenebis(3-methyl-6-tert-butylphenol), 2,2'-thiobis(4-methyl-6-tert-butylphenol), and 4,4'-thiobis(3-methyl-6-tert-butylphenol).

The amine antioxidant may be a diphenylamine antioxidant or a naphthylamine antioxidant. Specific examples of the diphenylamine antioxidant include diphenylmine and alkylated diphenylamine containing an alkyl group having 3 to 20 carbon atoms such as monooctyldiphenylamine, monononyldiphenylamine, 4,4'-dibutyldiphenylamine, 4,4'-dihexyldiphenylamine, 4,4'-dioctyldiphenylamine, 4,4'-dinonyldiphenylamine, tetrabutyldiphenylamine, tetrahexyldiphenylamine, tetraoctyldiphenylamine and tetranonyldiphenylamine. Specific examples of the naphthylamine antioxidant include alpha-naphthylamine, phenyl-alpha-naphthylamine and an alkyl-substituted phenyl-alpha-naphthylamine having 3 to 20 carbon atoms such as butylphenyl-alpha-naphthylamine, hexylphenyl-alpha-naphthylamine, octylphenyl-alpha-naphthylamine and nonylphenyl-alpha-naphthylamine. Among the above, the diphenylamine antioxidant is more suitable than the naphthylamine antioxidant in terms of effect, and the alkylated diphenylamine containing an alkyl group having 3 to 20 carbon atoms, in particular, 4,4'-di($C_3$ to $C_{20}$ alkyl)diphenylamine, is especially suitable.

In the exemplary embodiment, the antioxidant may be one selected from the above phenolic antioxidants and amine antioxidants or a combination of two selected therefrom. The blend ratio of the antioxidant is approximately in a range from 0.01 mass % to 5 mass % of the total amount of the composition in terms of a balance between an antioxidant effect and costs.

Examples of the detergent dispersant include an ashless dispersant and a metal detergent. Examples of the ashless dispersant include alkenyl succinimides, boron-containing alkenyl succinimides, benzylamines, boron-containing benzylamines, succinates, and amides of mono- or di-carboxylic acid typified by aliphatic or succinic acid. Examples of the metal detergent include neutral metal sulfonates, neutral metal phenates, neutral metal salicylates, neutral metal phosphonates, basic sulfonates, basic phenates, basic salicylates, overbased sulfonates, overbased salicylates and overbased phosphonates.

One of the above detergent dispersants may be used alone or two or more thereof may be used in combination. The above substances as the detergent dispersant are effective in dispersing sludge generated when the heat-treatment oil composition is repeatedly used, and the metal detergent also functions as a neutralizer for deteriorated acid. The blend ratio of the detergent dispersant is approximately in a range from 0.01 mass % to 5 mass % of the total amount of the composition in terms of a balance between effect and costs.

The present heat-treatment oil composition can provide an excellent luster when used for a heat treatment of a metal material. The present heat-treatment oil composition is thus suitably usable as a heat-treatment oil for a heat treatment (e.g., quenching, annealing and tempering), preferably as a quenchant for quenching, of various alloy steels such as carbon steel, nickel-manganese steel, chrome-molybdenum steel and manganese steel.

In quenching a metal material such as steel using the present heat-treatment oil composition, the temperature of the heat-treatment oil composition (i.e., a quenchant) may be set in a typical range for quenching (approximately, from 60 to 150 degrees C.) or in a high-temperature range from 170 to 250 degrees C.

EXAMPLES

Next, the invention will be described in further detail with reference to Examples and Comparatives, which by no means limit the invention. Specifically, the properties of the heat-treatment oil composition were evaluated in the following method.

Examples 1 to 7 and Comparatives 1 to 4

Sample Oil

Tables 1 and 2 show the compositional element(s) and properties of a sample oil used in each of Examples and Comparatives.

TABLE 1

| | | | | | Ex. 1 | Comp. 1 | Comp. 2 | Comp. 3 |
|---|---|---|---|---|---|---|---|---|
| Compositional Elements (mass %) | | Base Oil | | Base Oil 1 (70N) [1] | 91 | 100 | 94 | 97 |
| | | Additives | | Hydroxy Fused Fatty Acid Ester[2] | 9 | — | — | — |
| | | | | Asphaltene[3] | — | — | 6 | — |
| | | | | Polybutene[4] | — | — | — | 3 |
| | | Total | | | 100 | 100 | 100 | 100 |
| Evaluation Results | | Luster | | S45C Lightness | 0 | 1 | 2 | 0 |
| | | | | SUJ2 Lightness | 1 | 2 | 2 | 0 |
| | Induction-heating Degradation Test | Before Test | Kinematic Viscosity (40° C.) ($mm^2/s$) | | 18.58 | 13.69 | 18.45 | 18.05 |
| | | | Cooling Performance (80° C.) | H-value (/cm) | 0.135 | 0.119 | 0.148 | 0.144 |
| | | | | Characteristic Seconds (sec) | 2.86 | 4.71 | 1.89 | 1.97 |
| | | After Test | Kinematic Viscosity (40° C.) ($mm^2/s$) | | 18.99 | 14.16 | 18.66 | 15.68 |
| | | | Change Ratio before and after Test (%) | | 2 | 3 | 1 | −13 |
| | | | Cooling Performance (80° C.) | H-value (/cm) | 0.136 | 0.124 | 0.149 | 0.136 |
| | | | | Change Ratio before and after Test (%) | 1 | 4 | 1 | −6 |
| | | | | Characteristic Seconds (sec) | 2.77 | 4.37 | 1.95 | 3.41 |
| | | | | Change Ratio before and after Test (%) | −3 | −7 | 3 | 73 |

1) base oil 1: mineral oil (kinematic viscosity at 40 degrees C.: 17 $mm^2/s$)

2) hydroxy fused fatty acid ester (MINERASOL LB-703, manufactured by ITOH OIL CHEMICAL CO., LTD.)

3) asphaltene (PAS)

4) polybutene (Idemitsu Polybutene 2000H, manufactured by IDEMITSU KOSAN CO., LTD.)

TABLE 2

| | | | Ex. 2 | Ex. 3 | Ex. 4 | Ex. 5 | Ex. 6 | Ex. 7 | Comp. 4 |
|---|---|---|---|---|---|---|---|---|---|
| Compositional Elements (mass %) | Base Oil | Base Oil 2 (100N) 5) | 99 | 97 | 90 | 97 | 97 | — | 100 |
| | | Hydroxy Fused Fatty Acid Ester2) | — | — | — | — | — | 100 | — |
| | Additives | Hydroxy Fused Fatty Acid6) | 1 | 3 | 10 | — | — | — | — |
| | | Hydroxy Fused Fatty Acid Ester7) | — | — | — | 3 | — | — | — |
| | | Hydroxy Fused Fatty Acid Ester2) | — | — | — | — | 3 | — | — |
| | | Total | 100 | 100 | 100 | 100 | 100 | 100 | 100 |
| Evaluation Items | Kinematic Viscosity (40° C.) ($mm^2/s$) | | 20.11 | 21.86 | 28.91 | 21.8 | 20.95 | 334.3 | 19.57 |
| | Cooling Performance (80° C.) | H-value (/cm) | 0.118 | 0.122 | 0.124 | 0.124 | 0.12 | 0.099*1) | 0.113 |
| | | Characteristic Seconds (sec) | 2.91 | 1.93 | 1.48 | 1.74 | 2.19 | 0.29*1) | 3.45 |

5) base oil 2: mineral oil (kinematic viscosity at 40 degrees C.: 26 $mm^2/s$)

2) hydroxy fused fatty acid ester (MINERASOL LB-703, manufactured by ITOH OIL CHEMICAL CO., LTD.)

6) hydroxy fused fatty acid (MINERASOL PCF-30, manufactured by ITOH OIL CHEMICAL CO., LTD.)

7) hydroxy fused fatty acid ester (MINERASOL LB-601, manufactured by ITOH OIL CHEMICAL CO., LTD.)

*1) cooling performance at 130 degrees C.

Evaluation Method

Each sample oil was evaluated by the following method in terms of cooling performance, luster and pyrolysis characteristics. The results are shown in Tables 1 and 2.

(1) Cooling Performance Evaluation

According a cooling performance test defined in JIS K2242, a silver sample piece heated to 810 degrees C. was immersed in each sample oil, and a cooling curve of the silver sample piece was measured to obtain characteristic seconds and H-value below.

(1.1) Characteristic Seconds

Time (seconds) elapsed before a characteristic temperature (a temperature where a vapor film stage came to end) was reached according to the cooling curve was measured.

(1.2) H-Value (Quenching Intensity)

The H-value was derived from a cooling time elapsed before the temperature dropped to 300 degrees C. from 800 degrees C. according to the cooling curve.

(2) Quenching Test and Luster Evaluation

The test was performed with reference to "Netsushoriyuso nai no sanso ni yoru koukisei heno eikyo (study on the influence on luster due to oxygen in a heat-treatment bath)" (Idemitsu Tribo Review, No. 31, pp. 1963 to 1966, published on Sep. 30, 2008). Specifically, the test was performed as follows.

A sample piece was first prepared by combining a dumbbell-shaped metal material (diameter: 16 mm, S45C) and a cylindrical metal material (diameter: 10 mm, SUJ2). The sample piece was heated up to 850 degrees C. in an atmosphere of a mixed gas of nitrogen and hydrogen. The heated sample piece was then immersed in each sample oil of 80 degrees C. to be quenched.

Next, the quenched sample piece was evaluated in terms of "Lightness". Specifically, the evaluation was performed as follows.

(2.1) Lightness

The color of the quenched sample piece was evaluated by comparison with a luster/lightness standard color. The lightness was ranked on the following scale.

0: the lightness is 85% or higher

1: the lightness is not less than 60% and less than 85%

2: the lightness is less than 60%

(3) Pyrolysis Characteristics Evaluation

Prior to an induction-heating degradation test, the cooling performance evaluation (1) was performed and the evaluation result was employed as a pre-test value. Next, the induction-heating degradation test was performed under the following conditions. After the degradation test, the cooling performance evaluation (1) was again performed to obtain a post-test value.

Test Conditions

Test Piece: SUS304 (25 in diameter×50 mm)

Quenching Temperature: 850 degrees C. (induction-heating at 25 kHz)

Oil Amount: 400 ml

Oil Temperature: 130 degrees C.

Stirring: 200 rpm

Insufflation of Nitrogen: 200 ml/min

Quenching Time: three minutes

Number of Quenching: 100 times

Evaluation Results

Regarding the pyrolysis characteristics evaluation, Examples 1 and Comparatives 1 and 2 each experienced a small change in the kinematic viscosity and a small increase in the characteristic seconds after the induction-heating test, as shown in Table 1. Regarding the luster evaluation, Example 1 and Comparative 3 each provided an excellent luster.

The results of Examples 2 to 6 and Comparative 4 shown in Table 2 demonstrate that a vapor-film rupturing effect can be obtained by blending the component (B) (a base oil) with the component (A) in a ratio from 1 mass % to 10 mass %.

It has also been demonstrated that Comparative 7, in which the sample oil consists solely of the component (A), exhibits an excellent vapor-film rupturing effect.

The invention claimed is:

1. A heat-treatment oil composition, comprising a component (A) that is at least one of a hydroxy fused fatty acid having a polymerization degree of 2 or more and a derivative of the hydroxy fused fatty acid.

2. The heat-treatment oil composition according to claim 1, further comprising a component (B) that is at least one of a mineral oil and a synthetic oil.

3. The heat-treatment oil composition according to claim 2, wherein:

a blend ratio of the component (A) ranges from 1 mass % to 10 mass % of a total amount of the heat-treatment oil composition; and a blend ratio of the component (B) ranges from 90 mass % to 99 mass % of the total amount of the heat-treatment oil composition.

4. The heat-treatment oil composition according to claim 1, wherein the component (A) comprises the derivative of the hydroxy fused fatty acid, which comprises at least one of an esterified product of the hydroxy fused fatty acid, an amidated product of the hydroxy fused fatty acid and a hydrogenated product of the hydroxy fused fatty acid.

5. The heat-treatment oil composition according to claim 1, wherein a polymerization degree of the hydroxy fused fatty acid in the component (A) ranges from 2 to 10.

6. The heat-treatment oil composition according to claim 1, wherein the hydroxy fused fatty acid in the component (A) is prepared by fusing a hydroxy fatty acid consisting mainly of a ricinoleic acid.

7. The heat-treatment oil composition according to claim 1, wherein characteristic seconds of the heat-treatment oil composition according to a cooling performance test (JIS K 2242) are three seconds or less.

8. The heat-treatment oil composition according to claim 1, wherein the component (A) is at least one of the hydroxy fused fatty acid prepared by esterifying a hydroxyl group of a hydroxy fatty acid with a carboxylic acid.

* * * * *